US011565842B2

(12) United States Patent
Lancaster, III

(10) Patent No.: US 11,565,842 B2
(45) Date of Patent: Jan. 31, 2023

(54) PACKAGING MATERIAL QUALITY COMPENSATION

(71) Applicant: Lantech.com, LLC, Louisville, KY (US)

(72) Inventor: Patrick R. Lancaster, III, Louisville, KY (US)

(73) Assignee: LANTECH.COM, LLC, Louisville, KY (US)

( * ) Notice: Subject to any disclaimer, the term of this patent is extended or adjusted under 35 U.S.C. 154(b) by 58 days.

(21) Appl. No.: 16/648,533

(22) PCT Filed: Sep. 21, 2018

(86) PCT No.: PCT/IB2018/057339
§ 371 (c)(1),
(2) Date: Mar. 18, 2020

(87) PCT Pub. No.: WO2019/058334
PCT Pub. Date: Mar. 28, 2019

(65) Prior Publication Data

US 2020/0377250 A1 Dec. 3, 2020

Related U.S. Application Data

(60) Provisional application No. 62/562,114, filed on Sep. 22, 2017.

(51) Int. Cl.
*B65B 57/04* (2006.01)
*B65B 11/04* (2006.01)
(Continued)

(52) U.S. Cl.
CPC ..... *B65B 57/04* (2013.01); *B65B 11/045* (2013.01); *B65B 41/16* (2013.01); *B65B 57/12* (2013.01);
(Continued)

(58) Field of Classification Search
USPC ..... 53/64
See application file for complete search history.

(56) References Cited

U.S. PATENT DOCUMENTS 4,079,565 A * 3/1978 Lancaster, III ..... B65B 11/025 53/556
4,496,417 A 1/1985 Haake et al.
(Continued)

FOREIGN PATENT DOCUMENTS

CN 203551161 U 4/2014
EP 3941867 A1 1/2022
(Continued)

OTHER PUBLICATIONS

Canadian Intellectual Property Office; Office Action in Application No. 3076449 dated Dec. 2, 2021.
(Continued)

*Primary Examiner* — Chinyere J Rushing-Tucker
(74) *Attorney, Agent, or Firm* — Middleton Reutlinger

(57) ABSTRACT

A method, apparatus and program product may utilize packaging material quality compensation to sense changes in certain characteristics of a packaging material that can be associated with increased risks of film breaks, and automatically make certain changes in machine settings to mitigate the impact of those enhanced risks.

54 Claims, 7 Drawing Sheets

(51) Int. Cl.

| | |
|---|---|
| ***B65B 41/16*** | (2006.01) |
| ***B65B 57/12*** | (2006.01) |
| ***B65B 57/14*** | (2006.01) |
| ***B65B 57/18*** | (2006.01) |
| *B65B 11/00* | (2006.01) |

(52) U.S. Cl.
CPC ..... *B65B 57/14* (2013.01); *B65B 57/18* (2013.01); *B65B 2011/002* (2013.01)

(56) References Cited

U.S. PATENT DOCUMENTS

| | | | | |
|---|---|---|---|---|
| 4,503,658 | A | 3/1985 | Mouser | |
| 4,519,249 | A | 5/1985 | Hunt | |
| 4,682,038 | A | 7/1987 | Focke | |
| 5,426,509 | A | 6/1995 | Peplinski | |
| 5,488,814 | A | 2/1996 | Rankin et al. | |
| 5,572,850 | A | 11/1996 | Lancaster et al. | |
| 5,765,344 | A | 6/1998 | Mandeville et al. | |
| 6,314,333 | B1 | 11/2001 | Rajala et al. | |
| 7,568,327 | B2 | 8/2009 | Lancaster | |
| 7,707,901 | B2 | 5/2010 | Lancaster et al. | |
| 7,773,226 | B2 | 8/2010 | Hofeldt et al. | |
| 8,053,056 | B2 | 11/2011 | Heikaus et al. | |
| 8,739,502 | B2 | 6/2014 | Lancaster | |
| 8,939,338 | B2 | 1/2015 | Turner et al. | |
| 9,896,229 | B1 | 2/2018 | Pierson et al. | |
| 2004/0182043 | A1 | 9/2004 | Viaud et al. | |
| 2006/0164647 | A1 | 7/2006 | Shibata | |
| 2006/0254225 | A1 | 11/2006 | Lancaster et al. | |
| 2007/0204564 | A1* | 9/2007 | Lancaster, III | B65B 57/04 53/399 |
| 2007/0204565 | A1 | 9/2007 | Lancaster et al. | |
| 2009/0178374 | A1* | 7/2009 | Lancaster, III | B65B 57/02 700/240 |
| 2009/0235617 | A1* | 9/2009 | Moore | B65B 11/045 53/461 |
| 2010/0163443 | A1 | 7/2010 | Störig et al. | |
| 2011/0131927 | A1 | 6/2011 | Lancaster et al. | |
| 2011/0179752 | A1 | 7/2011 | Lancaster et al. | |
| 2013/0069284 | A1 | 3/2013 | De Bruin | |
| 2013/0076753 | A1* | 3/2013 | Lancaster, III | B65B 11/045 345/440 |
| 2014/0116006 | A1 | 5/2014 | Lancaster et al. | |
| 2014/0116007 | A1 | 5/2014 | Lancaster et al. | |
| 2014/0116008 | A1 | 5/2014 | Lancaster et al. | |
| 2014/0223863 | A1 | 8/2014 | Lancaster et al. | |
| 2014/0223864 | A1 | 8/2014 | Lancaster, III | |
| 2015/0197360 | A1 | 7/2015 | Lancaster et al. | |
| 2015/0353220 | A1 | 12/2015 | Lancaster et al. | |
| 2016/0096646 | A1 | 4/2016 | Lancaster, III et al. | |
| 2016/0098171 | A1 | 4/2016 | Lancaster et al. | |
| 2016/0229573 | A1* | 8/2016 | Grassi | B65B 11/02 |
| 2016/0231252 | A1 | 8/2016 | Herrmann et al. | |
| 2017/0052075 | A1 | 2/2017 | Ceré | |
| 2017/0057680 | A1 | 3/2017 | Schlichting | |
| 2017/0088301 | A1* | 3/2017 | Riemenschneider, III | B65B 41/16 |
| 2017/0267480 | A1 | 9/2017 | Sakamoto | |
| 2018/0257799 | A1 | 9/2018 | Ragsdale | |
| 2018/0257802 | A1 | 9/2018 | Resch et al. | |

FOREIGN PATENT DOCUMENTS

| | | | |
|---|---|---|---|
| EP | 3941868 | A1 | 1/2022 |
| EP | 3941869 | A1 | 1/2022 |
| WO | WO2016164776 | A1 | 10/2016 |

OTHER PUBLICATIONS

European Patent Office; Communication in Application No. 18858849.5 dated May 14, 2021.
Related Applications Transmittal dated May 13, 2021.
International Search Report and Written Opinion in application PCT/US2020/023087, dated Jun. 16, 2020.
International Search Report and Written Opinion in application PCT/US2020/023086, dated Jun. 26, 2020.
International Search Report and Written Opinion in application PCT/US2020/023088, dated Jun. 16, 2020.
Australian Government—IP Australia; Notice of Acceptance in Application No. 2018336150 dated Nov. 10, 2021.
Canadian Intellectual Property Office; Office Action in Application No. 3076449 dated May 21, 2021.
Australian Patent Office, Examination Report No. 1 for Application No. 2018336150, dated Jan. 29, 2021.
Australian Government—IP Australia; Full Examination Report in Application No. 2018336150 dated Jun. 29, 2021.
International Search Report and Written Opinion in application PCT/IB2018/057339, dated Jan. 25, 2019.
Canadian Intellectual Property Office; Office Action in Application No. 3076449 dated Jul. 14, 2022.

* cited by examiner

PACKAGING MATERIAL QUALITY COMPENSATION

FIELD OF THE INVENTION

The invention generally relates to wrapping loads with packaging material through relative rotation of loads and a packaging material dispenser.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material, e.g., film, around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

Film breaks are one of the most frequent and problematic sources of machine downtime and loss of "centerline" wrapper settings to a standard. Film breaks have many causes inherent to the wrapping process that can be mitigated, including, for example, irregularities or sharp points in the load or pallet, mechanical issues with rollers and clamps, electronic control issues around maintenance of film or packaging material tension during start, acceleration, and ending of a wrap operation or cycle, etc. These various causes of film breaks may be mitigated in many instances with more effective handling of the wrapping process.

However, film breaks are also impacted by fluctuations in the packaging material quality, where random and unpredictable changes in packaging material characteristics (often within a single packaging material roll) can cause a packaging material's resistance to film breaks to be reduced. Random flaws in a packaging material web such as gels, carbon particles, gauge band including shipping and handling damage to the packaging material roll remain problematic since they are generally difficult to sense or predict.

When film breaks occur from negative fluctuation in packaging material quality, many operators are left with the choice of tolerating the downtime and hassle of film breaks or lowering the packaging material tension until the film breaks are reduced to a tolerable level. The lowered packaging material tension either compromises the containment force and leaves loads more susceptible to damage during shipping, or requires additional layers (i.e., more packaging material) to maintain the desired containment force. Since there is generally no way for the operator to know when the packaging material quality fluctuations shift back more positive, the lowered packaging material tension effectively becomes the new normal, resulting in either increased occurrences of damaged loads or significantly wasted packaging material and longer cycle times.

SUMMARY OF THE INVENTION

The invention addresses these and other problems associated with the art by providing a method, apparatus and program product that utilize packaging material quality compensation to sense changes in certain characteristics of a packaging material that can be associated with increased risks of film breaks, and automatically make certain changes in machine settings to mitigate the impact of those enhanced risks.

Therefore, consistent with one aspect of the invention, a method of controlling a load wrapping apparatus of the type configured to wrap a load with packaging material dispensed from a packaging material dispenser through relative rotation between the packaging material dispenser and the load may include sensing one or more indications of changes in packaging material characteristics during one or more wrap operations, and changing one or more wrap parameters used to wrap the load in response to sensing the one or more indications.

In some embodiments, changing the one or more wrap parameters optimizes load wrapping apparatus performance and/or packaging material cost. In addition, in some embodiments changing the one or more wrap parameters reduces an incidence of film breaks.

In some embodiments, the one or more indications includes a packaging material gel, a packaging material hole, a force to pre-stretch at a given payout percentage, a tension at a payout percentage, an unwind force on a packaging material supply roll, and/or a visible packaging material roll surface. Further, in some embodiments, the visible packaging material roll surface includes one or more of a wrinkle, air entrapment, edge feather, edge flaw, torn edge, nicked edge, die line, and/or gauge band.

In some embodiments, the one or more wrap parameters includes a payout percentage, a tension, a pre-stretch percentage, and/or a packaging material feed control, and in some embodiments, the one or more wrap parameters includes a roping mechanism parameter that controls roping or rolling of an edge of the packaging material. Some embodiments further include generating an alert to indicate to an operator an impact of any changes made.

In some embodiments, sensing the one or more indications is performed by a sensor array in a pre-stretch zone of the packaging material dispenser. In some embodiments, sensing the one or more indications includes sensing a gel on the packaging material with an image sensor directed at a web of the packaging material. In addition, in some embodiments, sensing the one or more indications includes sensing a hole in the packaging material with an ultrasonic sensor directed at a web of the packaging material, and in some embodiments, sensing the one or more indications includes sensing a force to pre-stretch at a given payout percentage with a force sensor coupled to an idle roller disposed between upstream and downstream dispensing rollers of a pre-stretch assembly. In some embodiments, sensing the one or more indications includes sensing a tension at a given payout percentage with a force sensor coupled to an idle roller disposed downstream of a pre-stretch assembly, and in some embodiments, sensing the one or more indications includes sensing an unwind force on a packaging material supply roll with a force sensor coupled upstream of a pre-stretch assembly. Further, in some embodiments, sensing the one or more indications includes sensing a visible packaging material roll surface with an image sensor.

Some embodiments also include sensing a cessation of the one or more indications of changes in packaging material characteristics, and changing the one or more wrap parameters in response to sensing the cessation. In addition, in some embodiments, changing the one or more wrap parameters in response to sensing the cessation includes restoring the one or more wrap parameters to original values.

In some embodiments, sensing the one or more indications of changes in packaging material characteristics is performed during a first wrap operation, and changing the one or more wrap parameters used to wrap the load in response to sensing the one or more indications is performed during a second wrap operation. In other embodiments, sensing the one or more indications of changes in packaging material characteristics and changing the one or more wrap parameters used to wrap the load in response to sensing the one or more indications are performed during the same wrap operation.

Consistent with another aspect of the invention, a method of controlling a load wrapping apparatus of the type configured to wrap a load on a load support with packaging material dispensed from a packaging material dispenser through relative rotation between the packaging material dispenser and the load support may include sensing one or more indications of changes in packaging material characteristics during one or more wrap operations and indicative of a decrease in quality in the packaging material, changing one or more wrap parameters used to wrap the load in response to sensing the one or more indications, thereafter sensing a cessation of the one or more indications of changes in packaging material characteristics, and changing the one or more wrap parameters in response to sensing the cessation.

In some embodiments, changing the one or more wrap parameters in response to sensing the cessation includes restoring the one or more wrap parameters to original values.

Consistent with another aspect of the invention, an apparatus for wrapping a load with packaging material may include a packaging material dispenser for dispensing packaging material to the load, a rotational drive configured to generate relative rotation between the packaging material dispenser and the load about a center of rotation, and a controller coupled to the packaging material dispenser and the rotational drive and configured to sense one or more indications of changes in packaging material characteristics during one or more wrap operations, and change one or more wrap parameters used to wrap the load in response to sensing the one or more indications, and wrap the load using the changed one or more wrap parameters.

Some embodiments may also include an apparatus including a processor and program code configured upon execution by the processor to control a load wrapping apparatus of the type configured to wrap a load with packaging material dispensed from a packaging material dispenser through relative rotation between the packaging material dispenser and the load by performing any of the aforementioned operations, as well as a program product including a non-transitory computer readable medium and program code stored on the non-transitory computer readable medium and configured to control a load wrapping apparatus of the type configured to wrap a load with packaging material dispensed from a packaging material dispenser through relative rotation between the packaging material dispenser and the load by performing any of the aforementioned operations.

In some embodiments, the processor is in a controller of the load wrapping apparatus, and the apparatus further includes a packaging material dispenser for dispensing packaging material to the load, while in some embodiments, the processor is in a device external to the load wrapping apparatus. In some embodiments, the device is a mobile device, a single-user computer or a multi-user computer.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention.

DETAILED DESCRIPTION

Embodiments consistent with the invention may sense changes in certain characteristics of a packaging material that can be associated with increased risks of film breaks, and may automatically make certain changes in machine settings to mitigate the impact of those enhanced risks. Additionally, in some embodiments, changes in certain characteristics of packaging material that can be associated with reduced risk of film breaks may also be sensed and used to make certain changes in machine settings to benefit the wrap process in either cost or productivity. Prior to a further discussion of these techniques, however, a brief discussion of various types of wrapping apparatus within which the various techniques disclosed herein may be implemented is provided.

Wrapping Apparatus Configurations

Figure 1:
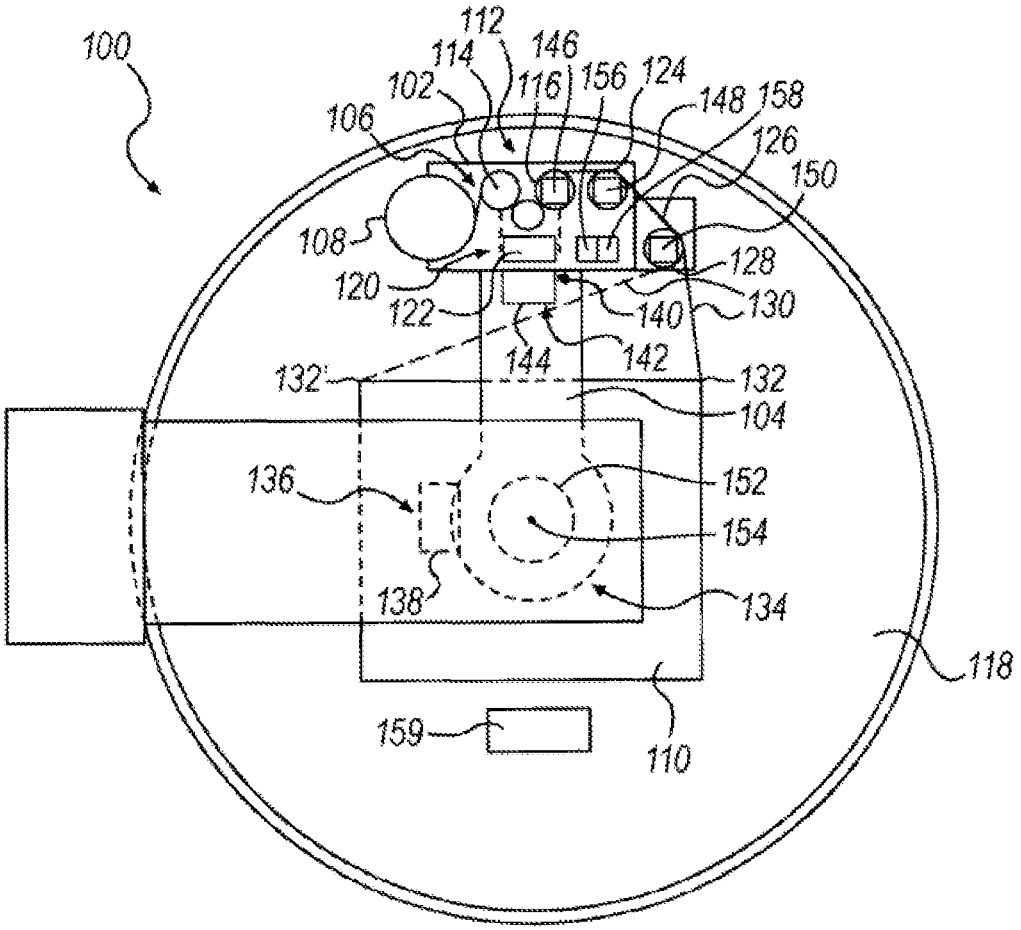
FIG. 1 shows a top view of a rotating arm-type wrapping apparatus consistent with the invention.

Various wrapping apparatus configurations may be used in various embodiments of the invention. For example, FIG. 1 illustrates a rotating arm-type wrapping apparatus 100, which includes a roll carriage or elevator 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an example embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material. In addition, as used herein, the terms "packaging material," "web," "film," "film web," and "packaging material web" may be used interchangeably. Moreover, the breakage of any of the aforementioned types of packaging materials will hereinafter be referred to as "film breaks," so the term should not be interpreted to imply that film breaks refer only to breakages occurring in film-type packaging material webs.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110 (or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114. Moreover, in some embodiments the roll of packaging material 108 may be undriven and may rotate freely, while in other embodiments the roll may be driven, e.g., by biasing a surface of the roll against upstream dispensing roller 114 or another driven roller, or by driving the roll directly.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined nor constant. Rather, the length may be adjusted periodically or continuously based on changing conditions. In other embodiments, however, packaging material dispenser 106 may be driven proportionally to the relative rotation, or alternatively, tension in the packaging material extending between the packaging material dispenser and the load may be used to drive the packaging material dispenser.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, generally in a direction parallel to an axis of rotation between the packaging material dispenser 106 and load 110 and load support surface 118. For example, for wrapping apparatus 100, lift drive system 142 may drive roll carriage 102 and packaging material dispenser 106 upwards and downwards vertically on rotating arm 104 while roll carriage 102 and packaging material dispenser 106 are rotated about load 110 by rotational drive system 136, to wrap packaging material spirally about load 110.

One or more of downstream dispensing roller 116, idle roller 124 and idle roller 126 may include a corresponding sensor 146, 148, 150 to monitor rotation of the respective roller. In particular, rollers 116, 124 and/or 126, and/or packaging material 108 dispensed thereby, may be used to monitor a dispense rate of packaging material dispenser 106, e.g., by monitoring the rotational speed of rollers 116, 124 and/or 126, the number of rotations undergone by such rollers, the amount and/or speed of packaging material dispensed by such rollers, and/or one or more performance parameters indicative of the operating state of packaging material drive system 120, including, for example, a speed of packaging material drive system 120. The monitored characteristics may also provide an indication of the amount of packaging material 108 being dispensed and wrapped onto load 110. In addition, in some embodiments a sensor, e.g., sensor 148 or 150, may be used to detect a break in the packaging material.

Wrapping apparatus also includes an angle sensor 152 for determining an angular relationship between load 110 and packaging material dispenser 106 about a center of rotation 154. Angle sensor 152 may be implemented, for example, as a rotary encoder, or alternatively, using any number of alternate sensors or sensor arrays capable of providing an indication of the angular relationship and distinguishing from among multiple angles throughout the relative rotation, e.g., an array of proximity switches, optical encoders, magnetic encoders, electrical sensors, mechanical sensors, photodetectors, motion sensors, etc. The angular relationship may be represented in some embodiments in terms of degrees or fractions of degrees, while in other embodiments a lower resolution may be adequate. It will also be appreciated that an angle sensor consistent with the invention may also be disposed in other locations on wrapping apparatus 100, e.g., about the periphery or mounted on arm 104 or roll carriage 102. In addition, in some embodiments angular relationship may be represented and/or measured in units of time, based upon a known rotational speed of the load relative to the packaging material dispenser, from which a time to complete a full revolution may be derived such that segments of the revolution time would correspond to particular angular relationships. Other sensors may also be used to determine the height and/or other dimensions of a load, among other information.

Additional sensors, such as a load distance sensor 156 and/or a film angle sensor 158, may also be provided on wrapping apparatus 100. Load distance sensor 156 may be used to measure a distance from a reference point to a surface of load 110 as the load rotates relative to packaging material dispenser 106 and thereby determine a cross-sectional dimension of the load at a predetermined angular position relative to the packaging material dispenser. In one embodiment, load distance sensor 156 measures distance along a radial from center of rotation 154, and based on the known, fixed distance between the sensor and the center of rotation, the dimension of the load may be determined by subtracting the sensed distance from this fixed distance. Sensor 156 may be implemented using various types of distance sensors, e.g., a photoeye, proximity detector, laser distance measurer, ultrasonic distance measurer, electronic rangefinder, and/or any other suitable distance measuring device. Exemplary distance measuring devices may include, for example, an IFM Effector 01D100 and a Sick UM30-213118 (6036923).

Film angle sensor 158 may be used to determine a film angle for portion 130 of packaging material 108, which may be relative, for example, to a radial (not shown in FIG. 1) extending from center of rotation 154 to exit point 128 (although other reference lines may be used in the alternative). In one embodiment, film angle sensor 158 may be implemented using a distance sensor, e.g., a photoeye, proximity detector, laser distance measurer, ultrasonic distance measurer, electronic rangefinder, and/or any other suitable distance measuring device. In one embodiment, an IFM Effector 01D100 and a Sick UM30-213118 (6036923) may be used for film angle sensor 158. In other embodiments, film angle sensor 158 may be implemented mechanically, e.g., using a cantilevered or rockered follower arm having a free end that rides along the surface of portion 130 of packaging material 108 such that movement of the follower arm tracks movement of the packaging material. In still other embodiments, a film angle sensor may be implemented by a force sensor that senses force changes resulting from movement of portion 130 through a range of film angles, or a sensor array (e.g., an image sensor) that is positioned above or below the plane of portion 130 to sense an edge of the packaging material.

In other embodiments, some or all of sensors 146, 148, 150, 152, 156, 158 may be omitted.

Wrapping apparatus 100 may also include additional components used in connection with other aspects of a wrapping operation. For example, a clamping device 159 may be used to grip the leading end of packaging material 108 between wrap operations or cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
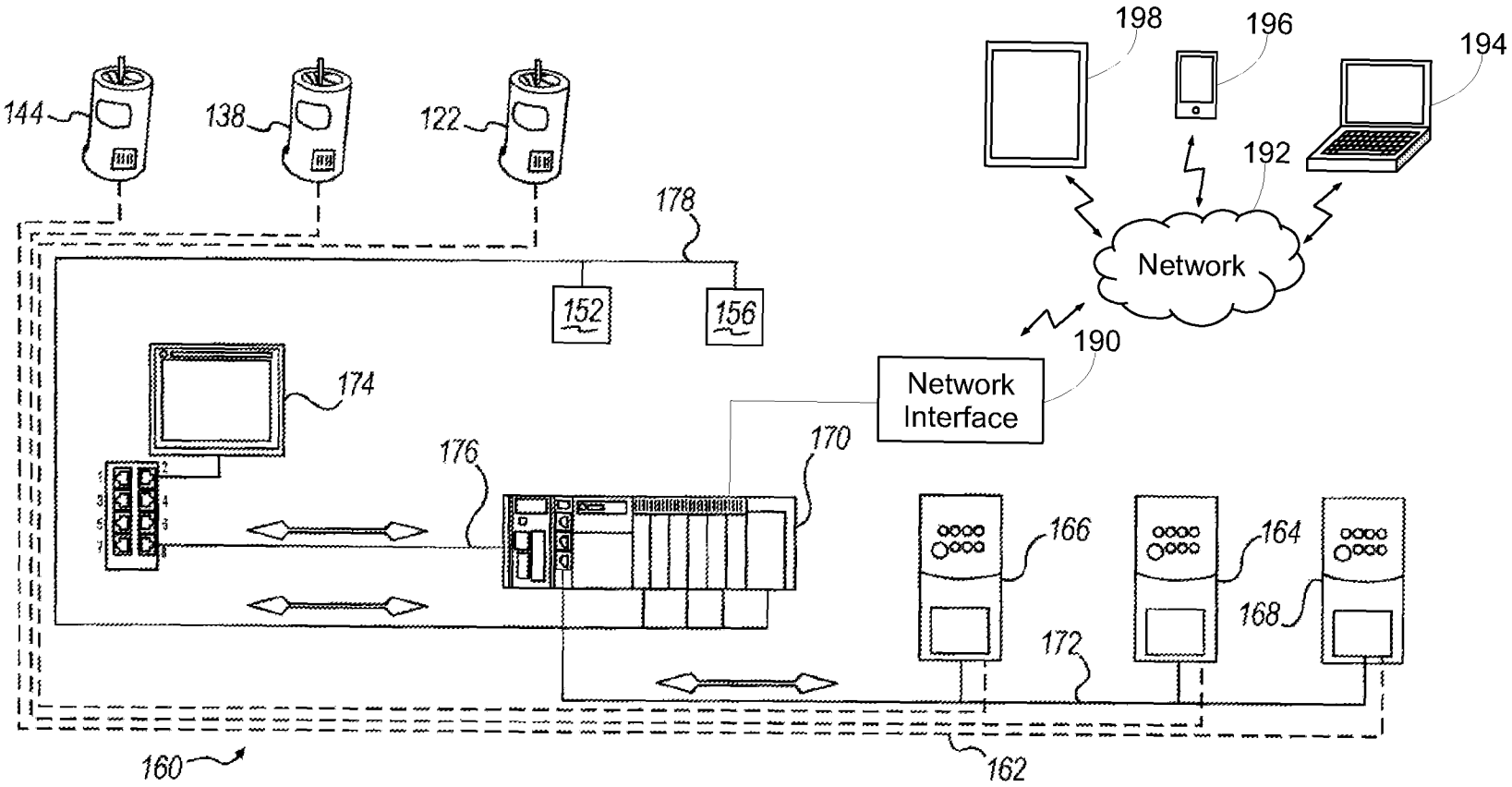
FIG. 2 is a schematic view of an example control system for use in the apparatus of FIG. 1.

An example schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement.

Controller 170 in the embodiment illustrated in FIG. 2 is a local controller that is physically co-located with the packaging material drive system 120, rotational drive system 136 and lift drive system 142. Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrap operation. Controller 170 may also communicate with one or more sensors, e.g., sensors 152 and 156, among others, through a data link 178 to allow controller 170 to receive feedback and/or performance-related data during wrapping, such as roller and/or drive rotation speeds, load dimensional data, etc. It is contemplated that data links 162, 172, 176, and 178 may include any suitable wired and/or wireless communications media known in the art.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to the various drive systems 120, 136 and 142 of wrapping apparatus 100.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in CPU 52, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 100 is assumed to be incorporated wholly within components that are local to wrapping apparatus 100 illustrated in FIGS. 1-2, e.g., within components 162-178 described above. It will be appreciated, however, that in other embodiments, at least a portion of the functionality incorporated into a wrapping apparatus may be implemented in hardware and/or software that is external to the aforementioned components. For example, in some embodiments, some user interaction may be performed using an external device such as a networked computer or mobile device, with the external device converting user or other input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user or other input, converting the input into control variables for controlling a wrap operation, initiating and implementing a wrap operation based upon the control variables, providing feedback to a user, etc., may be implemented by various local and/or remote components and combinations thereof in different embodiments. In some embodiments, for example, an external device such as a mobile device, a networked computer, a server, a cloud service, etc. may generate a wrap model that defines the control variables for controlling a wrap operation for a particular load, and that wrap model may then be communicated to a wrapping apparatus and used by a controller therefor to control a dispense rate during a wrap operation. As such, the invention is not limited to the particular allocation of functionality described herein.

Figure 3:
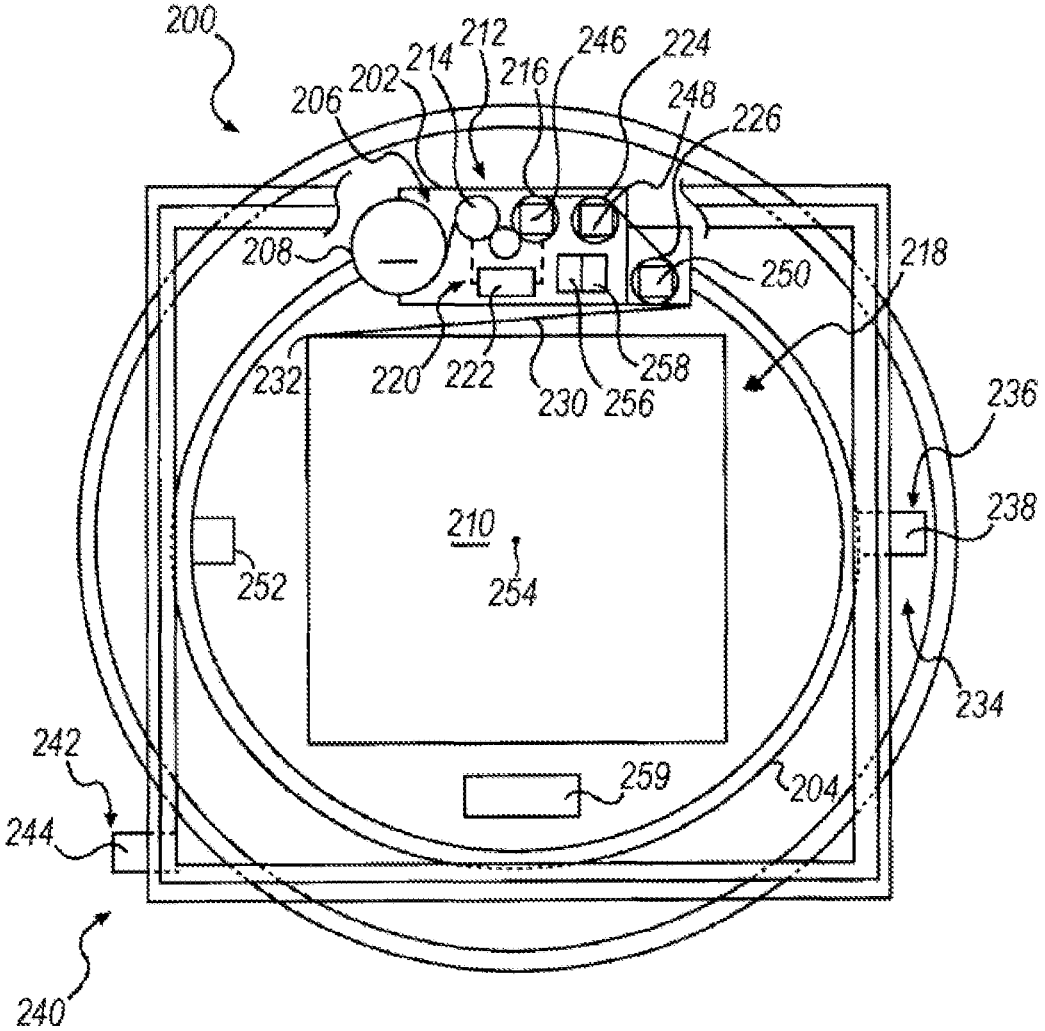
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage or elevator 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a pre-stretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In addition, similar to wrapping apparatus 100, wrapping apparatus 200 may include sensors 246, 248, 250 on one or more of downstream dispensing roller 216, idle roller 224 and idle roller 226. Furthermore, an angle sensor 252 may be provided for determining an angular relationship between load 210 and packaging material dispenser 206 about a center of rotation 254, and in some embodiments, one or both of a load distance sensor 256 and a film angle sensor 258 may also be provided. Sensor 252 may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles.

Figure 4:
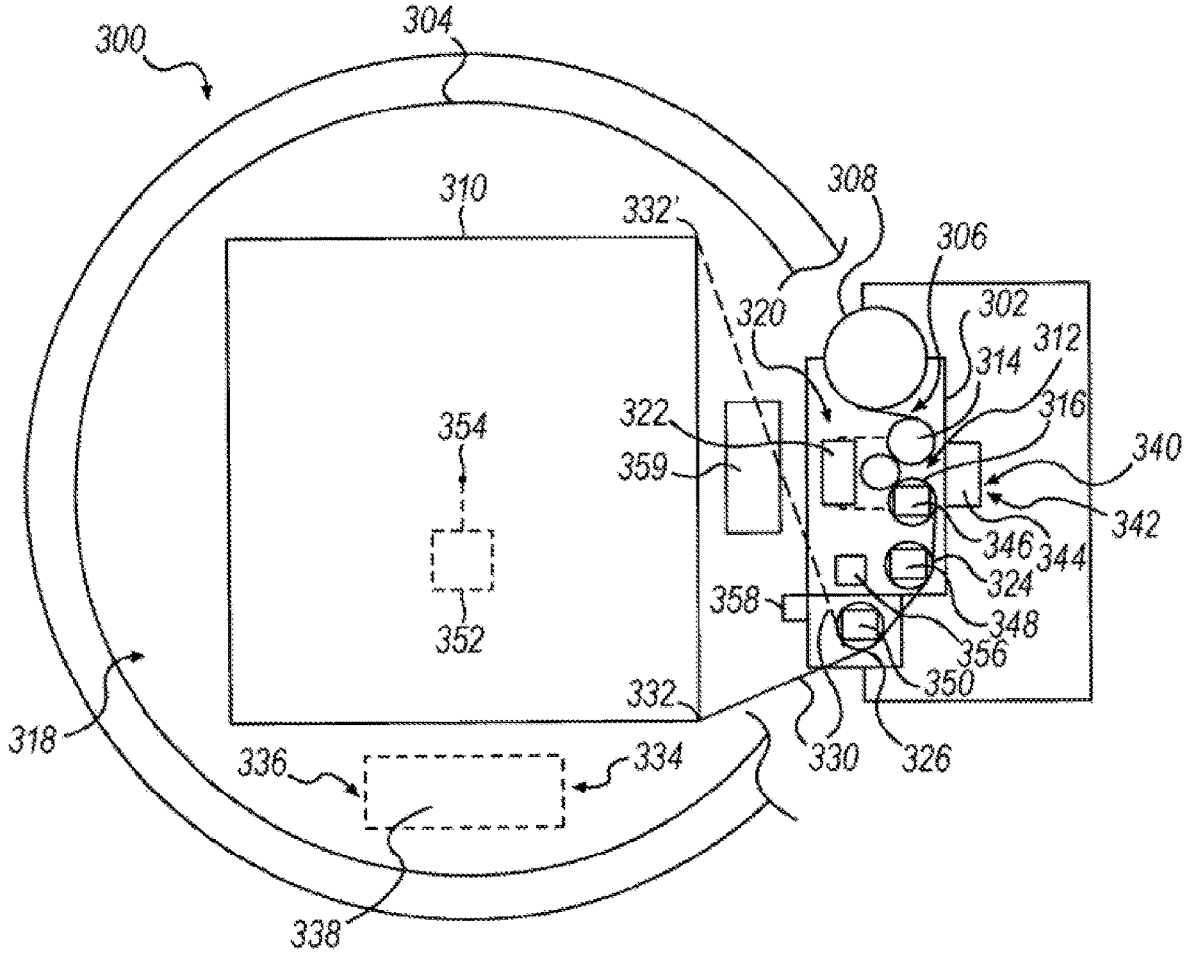
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage or elevator 102 that rotates around a fixed load 110 using a rotating arm 104, as in FIG. 1, wrapping apparatus 300 includes a rotating turntable 304 functioning as a load support 318 and configured to rotate load 310 about a center of rotation 354 (through which projects an axis of rotation that is perpendicular to the view illustrated in FIG. 4) while a packaging material dispenser 306 disposed on a roll carriage or elevator 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a pre-stretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move roll carriage or elevator 302 and packaging material dispenser 306 vertically relative to load 310.

In addition, similar to wrapping apparatus 100, wrapping apparatus 300 may include sensors 346, 348, 350 on one or more of downstream dispensing roller 316, idle roller 324 and idle roller 326. Furthermore, an angle sensor 352 may be provided for determining an angular relationship between load 310 and packaging material dispenser 306 about a center of rotation 354, and in some embodiments, one or both of a load distance sensor 356 and a film angle sensor 358 may also be provided. Sensor 352 may be positioned proximate center of rotation 354, or alternatively, may be positioned at other locations, such as proximate the edge of turntable 304. Wrapping apparatus 300 may also include additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the example environments illustrated in FIGS. 1-4 are not intended to limit the present invention. Indeed, those skilled in the art will recognize that other alternative environments may be used without departing from the scope of the invention.

Packaging Material Quality Compensation

In some embodiments, characteristics of packaging material that are associated with increased and/or reduced risks of film breaks may be sensed and used to change the settings of a load wrapping apparatus to improve the operation of the load wrapping apparatus, e.g., to mitigate the impact of risks and/or benefit the wrap process in either cost or productivity. In particular, it has been found that relationships exist between certain characteristics of packaging material and increased film breaks. Consistent with the invention, various mitigating strategies may be employed for each of these characteristics that may be initiated when changes to packaging material characteristics are sensed.

In some embodiments, for example, it has been found that certain changes in packaging material characteristics may be impactful, including: packaging material "gels" as measured with a high speed video camera, packaging material holes as measured by an ultrasonic sensor (e.g., a Sick Ultrasonic UC4-11341 6034667 film sensor), force to pre-stretch the packaging material at a given payout percentage, e.g., as measured by a load cell on an intermediate idle roller, packaging material tension at a specific payout percentage, e.g., as measured by a load cell on a downstream idle roller, unwind force on packaging material from a supply roll, and visible packaging material roll surface (e.g., wrinkles, air entrapment, edge feather, gauge bands, etc.), among others. These packaging material characteristics in some instances may be considered to be packaging material quality characteristics as they are indicative of the relative quality of a packaging material as compared to that packaging material's regular specifications.

Consistent with some embodiments of the invention, changes may be made to mitigate specific combinations of packaging material changes as sensed in the manner discussed above, including: change in payout percentage or packaging material tension, change in pre-stretch percentage, and/or change in packaging material feed control. In addition, in some embodiments, an alert notification (e.g., an alert banner) may be generated to indicate to an operator the impact of the changes made.

In some embodiments, for example, a sensor array may be provided in a pre-stretch or other zone of a film delivery system or packaging material dispenser, and in response to detecting one or more changes in packaging material characteristics, automatic adjustments may be made to mitigate these changes in packaging material characteristics and potentially decrease the incidence of film breaks during wrapping. It will be appreciated that in some embodiments, a control system of a wrapping apparatus may receive one or more indications of changes in packaging material characteristics and may, in response, react to such indications with changes to one or more wrapping apparatus settings to optimize machine performance and/or packaging material cost.

Figure 5:
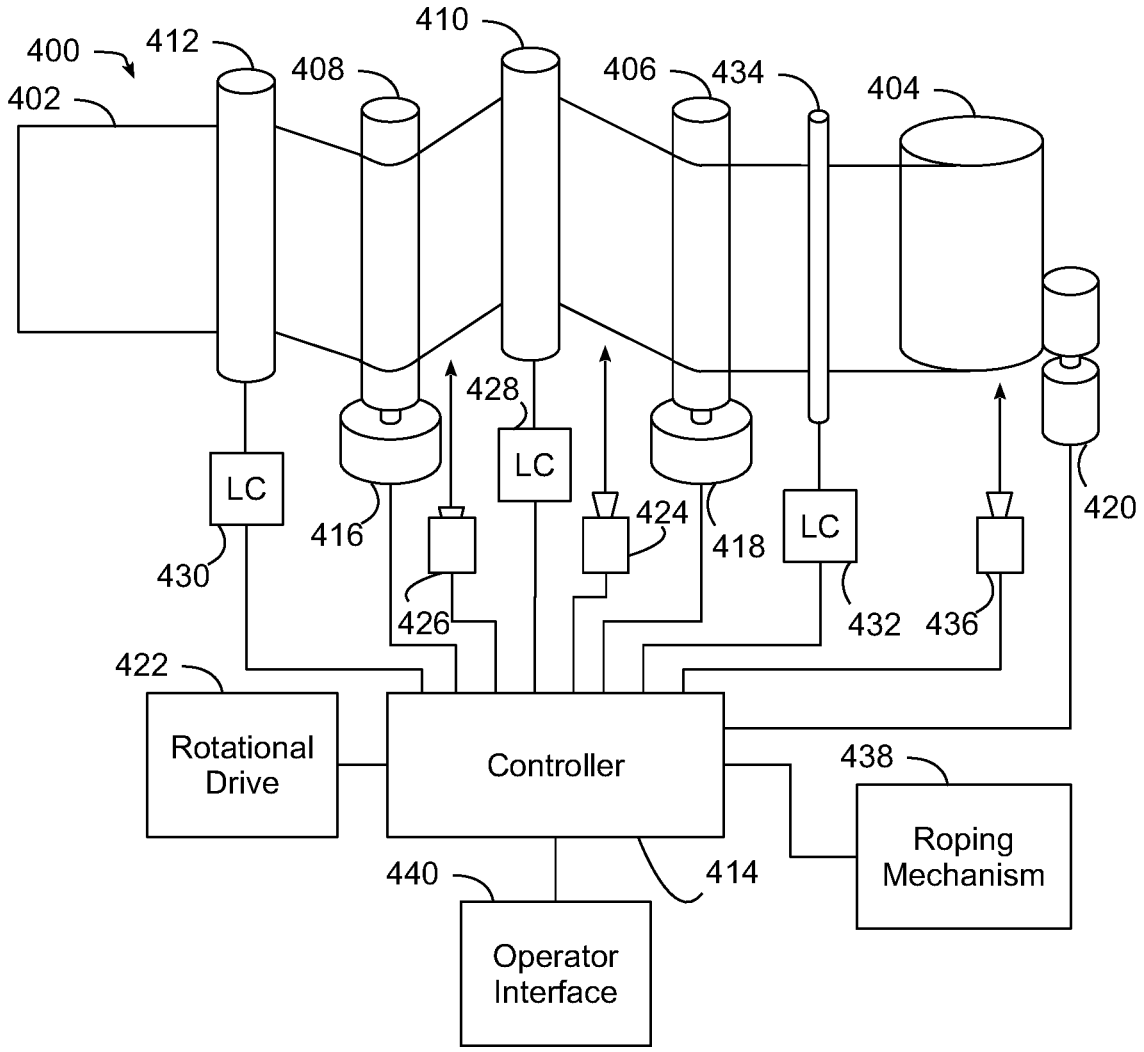
FIG. 5 functionally illustrates a load wrapping apparatus suitable for implementing packaging material quality compensation consistent with the invention.

Now turning to FIG. 5, this figure functionally illustrates an example load wrapping apparatus 400 consistent with some embodiments of the invention. Apparatus 400 may include a packaging material dispenser that dispenses a web of packaging material 402 from a roll 404 and past upstream and downstream dispensing rollers 406, 408 of a pre-stretch assembly, as well as between upstream and downstream idle rollers 410, 412 that are respectively disposed upstream and downstream of downstream dispensing roller 408. A controller 414 controls a dispense rate of the packaging material dispenser by controlling a packaging material drive 416 coupled to downstream dispensing roller 408. In addition, while in some embodiments dispensing rollers 406 and 408 may be mechanically coupled to one another to rotate at a fixed or adjustable ratio relative to one another to provide a fixed or adjustable pre-stretch, in other embodiments, and as illustrated in FIG. 5, dispensing roller 406 may be driven by a separate pre-stretch drive 418 that enables the pre-stretch ratio to be controlled electronically, and in some instances, dynamically during a wrap operation.

In addition, while in some embodiments, roll 404 may be unpowered, in other embodiments, including as shown in FIG. 5, the roll may be driven by a drive 420, which in some embodiments may be configured as an electronic brake.

During a wrap operation, controller 414 may control drives 416, 418 and 420 to control the dispensation of packaging material from roll 404 to a load, which when coupled with control over a rotational drive 422 that controls relative rotation between the packaging material dispenser and the load, wraps packaging material around the load in a controlled manner. It will be appreciated that additional aspects of controlling load wrapping apparatus 400, including, for example, carriage control and various sensors used to detect various aspects of a wrap operation, may also be incorporated into load wrapping apparatus 400 but are not illustrated in FIG. 5.

A suite of sensors 424-436 may be used in some embodiments to sense various characteristics of the packaging material that are associated with increased risk of film breaks, and controller 414 may be configured to alter one or more wrap parameters in response to these sensed characteristics, e.g., in response to detected changes in packaging material characteristics. It will be appreciated, however, that in other embodiments, different combinations of these sensors 424-436 may be used, and that some of such sensors may be used alone in some embodiments. Furthermore, the placement of these sensors can vary in different embodiments, so the various placements illustrated in FIG. 5 are not exclusive, and the invention is therefore not limited to the particular sensor placements illustrated herein. In particular, various locations within a pre-stretch or other zone of a packaging material dispenser, or within a film delivery system, may be used in different embodiments.

One type of sensor that may be used, for example, is an image sensor 424, e.g., a high speed video camera or other suitable image sensor, which can be used to sense the presence of packaging material "gels" formed on the surface of the packaging material. Gels are generally unmelted plastic in a packaging material web that can cause breaks towards the center of the packaging material, and may be detectable from image data collected by image sensor 424, e.g., when positioned between upstream dispensing roller 406 and upstream idle roller 410, or in another suitable location.

Another type of sensor that may be used, for example, is an ultrasonic sensor 426, e.g., a Sick Ultrasonic UC4-11341 6034667 film sensor, which can be used to sense holes in the packaging material web. Sensor 426 may be positioned between downstream idle roller 410 and downstream dispensing roller 408, or in other suitable locations. In some embodiments, positioning sensor 426 within the pre-stretch assembly or downstream of the pre-stretch assembly may be beneficial due to the fact that pre-stretching can enlarge holes in some instances, thereby making holes easier to detect.

Another type of sensor that may be used is force sensor 428, e.g., a load cell mechanically coupled to upstream idle roller 410 or another suitable arrangement for measuring tension (e.g., a dancer bar), to sense the tension in the packaging material between the upstream and downstream dispensing rollers 406, 408. Such a sensor may be used, for example, to sense the force required to pre-stretch the packaging material at a given payout percentage or other wrap force parameter.

Still another type of sensor that may be used is force sensor 430, e.g., a load cell mechanically coupled to downstream idle roller 412 or another suitable arrangement for measuring tension (e.g., a dancer bar), to sense the tension in the packaging material between the downstream dispensing roller 408 and the load. Such a sensor may be used, for example, to sense packaging material tension at a given payout percentage or other wrap force parameter.

Another type of sensor that may be used is force sensor 432, e.g., a load cell mechanically coupled to dancer bar 434, or alternatively an idle roller, to sense the tension in the packaging material between the roll 404 and upstream dispensing roller 406, which is indicative of an unwind force on the packaging material from the roll.

Still another type of sensor that may be used is an image sensor 436, e.g., a high speed video camera or other suitable image sensor, which can be used to sense the presence of defects on the surface of roll 404 and/or in the packaging material web 402 as it exits the roll, e.g., wrinkles, air entrapment, edge feather, gauge bands, die lines, nicked or torn edges, etc.

In response to the outputs of any of sensors 424-436, controller 414 may detect one or more characteristics of the packaging material associated with increased incidence of film breaks, and in response thereto, mitigate the risks by modifying one or more wrap parameters, e.g., to change a payout percentage, tension or other wrap force parameter (e.g., to vary the dispense rate controlled by packaging material drive 416 relative to the relative rotation rate controlled by rotational drive 422), to change a pre-stretch ratio or percentage (e.g., to vary the relative rates of rotation controlled by drives 416, 418), to change a packaging material feed control (e.g., to vary the drive or braking of roll 404 by drive 420), or various combinations thereof. In addition, other aspects of a wrap operation, e.g., the carriage speed, the number of layers of packaging material, etc., may also be varied in some embodiments, e.g., to maintain containment force by compensating for decreases in payout percentage or wrap force by wrapping the load with additional layers of packaging material. As another alternative, a parameter of a roping mechanism 438, which rolls or otherwise forms a rope along an edge of the packaging material web 402, may also be modified, e.g., to engage or disengage the mechanism, or to control an extent to which the edge of the web of packaging material is roped or rolled.

Moreover, whenever the outputs of any of sensors 424-436 indicate that any previously-sensed characteristics of the packaging material are no longer being detected (i.e., a positive change in packaging material characteristics, or a cessation in detecting indications of changes in packaging material characteristics indicative of a decrease in packaging material quality), controller 414 may restore any previously-modified wrap parameters to their original values, or otherwise modify the wrap parameters from the values selected when attempting to mitigate the incidence of film breaks. As one example, if a number of gels are detected along a length of the packaging material web, one or more wrap parameters may be modified from their original settings to decrease the likelihood of film breaks, and if later no gels are detected, the wrap parameters may be modified once again, but potentially to intermediate values that are not equal to the original values, but are still modified relative to those used when the gels were detected to accommodate the relatively higher risk that gels could be encountered on the same roll in the future.

In addition, in some embodiments, one or more alerts may be generated on an operator interface 440, e.g., via an audible alert, a visual alert (e.g., a banner) on a display mounted to the load wrapping apparatus, a visual alert on a mobile or other external device in communication with the load wrapping apparatus, a text or email alert communicated to a mobile or other external device in communication with the load wrapping apparatus, or other notifications as will be apparent to those of ordinary skill having the benefit of the instant disclosure.

Figure 6:
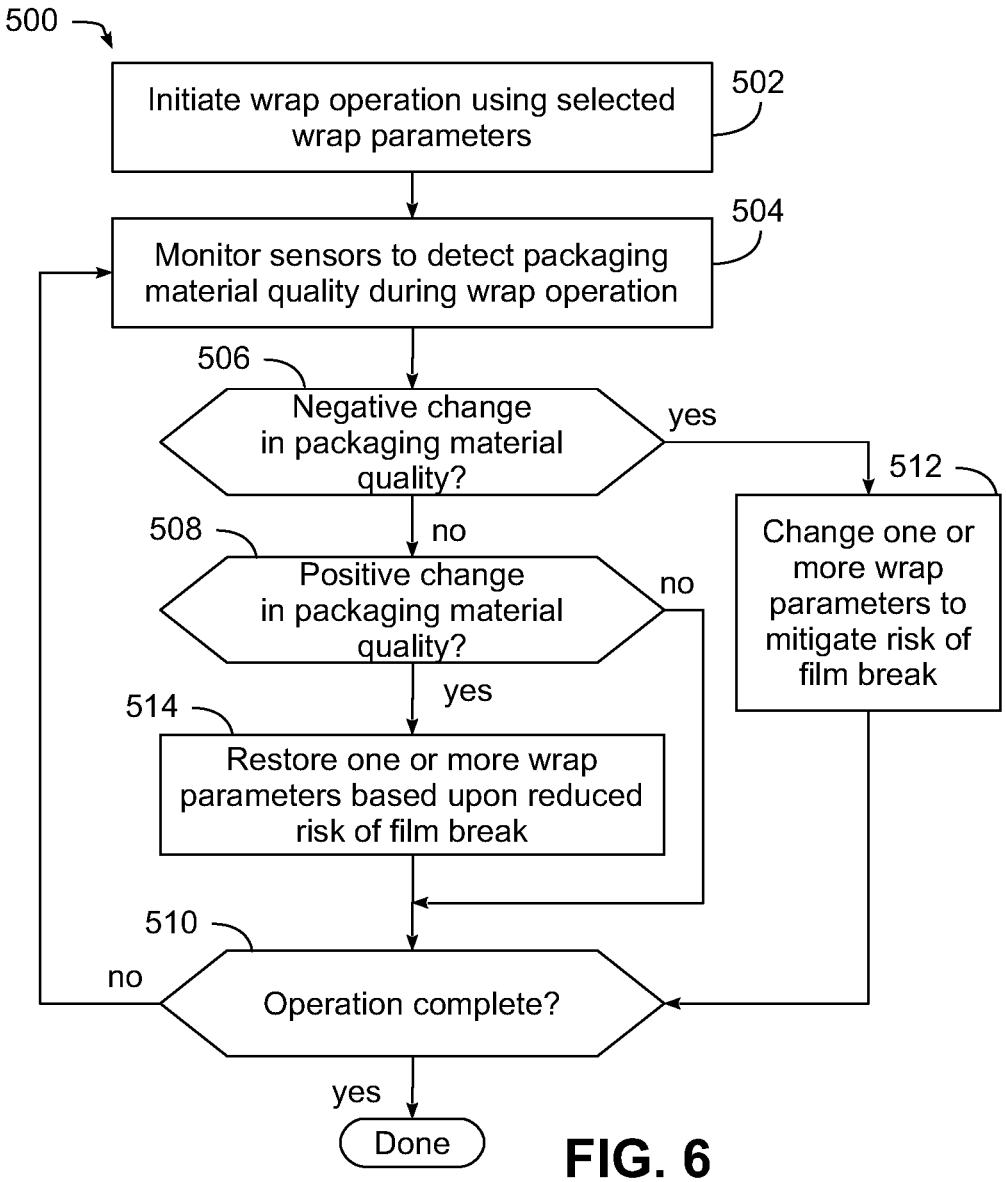
FIG. 6 is a flowchart illustrating an example sequence of operations for wrapping a load using the load wrapping apparatus of FIG. 5.

FIG. 6, for example, illustrates an example sequence of operations 500 suitable for execution by controller 414 of load wrapping apparatus 400 when performing a wrap operation. In block 502, the wrap operation is initiated using various selected parameters, e.g., payout percentage or wrap force, number of layers, tension, carriage speed, roping/no roping, etc. The selected parameters may be provided, for example, in a wrap profile retrieved by an operation, via manual input through the operator interface, or in other suitable manners.

Next, in block 504, the various sensors utilized in load wrapping apparatus 400 may be monitored to detect the packaging material quality during the wrap operation, i.e., to attempt to detect one or more characteristics of the packaging material that are associated with increased incidences of film breaks. Block 506 determines whether a negative change in packaging material quality has been detected, e.g., in response to sensing one or more characteristics exhibiting a greater risk of film breaks. If not, control passes to block 508 to determine whether a positive change in packaging material quality has been detected, e.g., in response to no longer sensing one or more characteristics exhibiting a greater risk of film breaks. If no changes have been detected in packaging material quality, block 508 passes control to block 510, which, so long as the wrap operation is not complete, passes control to block 504 to continue the wrap operation while continuing to monitor packaging material quality.

Returning to block 506, if a negative change in packaging material quality is detected, control passes to block 512 to change or modify one or more wrap parameters to mitigate the risk of film breaks, and then to block 510 to continue with the wrap operation using the modified wrap parameters. As an example, it may be determined that gels have been detected on the roll, and as a result it may be desirable to lower the payout percentage 10%, and potentially add another layer of packaging material to the load when wrapping.

Likewise, if a positive change in packaging material quality is detected, block 508 passes control to block 514 to restore one or more wrap parameters based upon the reduced risk of film breaks, and then to block 510 to continue with the wrap operation using the restored wrap parameters. It will be appreciated that in some embodiments, block 514 may simply restore original wrap parameters based upon a cessation of sensed indications of changes in packaging material characteristics. In other embodiments, however, block 514 may modify wrap parameters relative to those used to mitigate film breaks, while still using values that are different from the original wrap parameters.

In addition, while FIG. 6 illustrates a single wrap operation, in some embodiments, monitoring of packaging material quality may be performed over multiple wrap operations such that sensed indications of changes in one wrap operation may be used to vary one or more wrap parameters used in another wrap operation. It will be appreciated, in particular, that a single roll of packaging material may be used to wrap multiple loads, so if a quality issue is detected in the roll during one wrap operation, that quality issue will likely exist for subsequent wrap operations.

Figure 7:
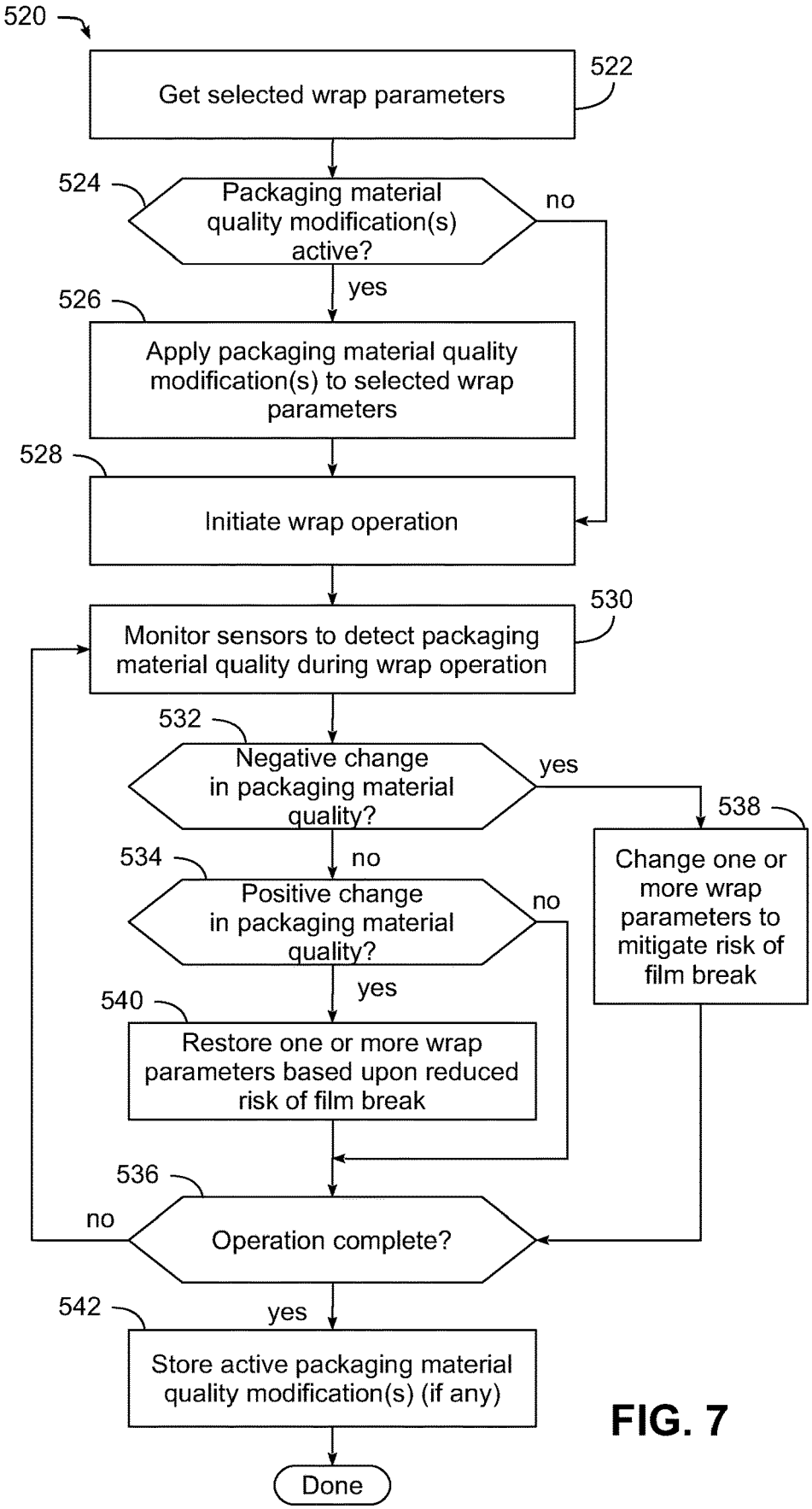
FIG. 7 is a flowchart illustrating another example sequence of operations for wrapping a load using the load wrapping apparatus of FIG. 5.

FIG. 7, for example, illustrates another example sequence of operations 520 suitable for execution by controller 414 of load wrapping apparatus 400 when performing a wrap operation. In block 522, the selected wrap parameters for the current wrap operation are obtained, and in block 524, a determination of whether any packaging material quality modifications are currently active, e.g., based upon the last wrap operation. If so, any active packaging material quality modifications are applied to the selected wrap parameters, e.g., to modify one or more of the selected wrap parameters to mitigate film break risks, and the wrap operation is initiated in block 528. As an example, from a prior wrap operation it may be determined that gels have been detected on the roll, and as a result it may be desirable to lower the payout percentage 10%, and potentially add another layer of packaging material to the load when wrapping. If no modifications are active, however, block 524 may bypass block 526, and proceed with the wrap operation using the selected wrap parameters.

Thereafter, as illustrated by blocks 530-540, wrapping proceeds in a similar manner to blocks 504-514 of FIG. 6. However, upon completion of the wrap operation, block 536 passes control to block 542 to store any active packaging material quality modification(s) for use in subsequent wrap operations (e.g., as described above in connection with blocks 524 and 526). As such, monitoring of packaging material quality and mitigation of film break risks may occur over the course of multiple wrap operations in some embodiments.

Other embodiments will be apparent to those skilled in the art from consideration of the specification and practice of the present invention. Therefore the invention lies in the claims set forth hereinafter.

What is claimed is:

1. A method of controlling a load wrapping apparatus of the type configured to wrap a load with packaging material dispensed from a packaging material dispenser through relative rotation between the packaging material dispenser and the load, the method comprising:

sensing one or more indications of changes in packaging material characteristics during one or more wrap operations; and changing one or more wrap parameters used to wrap the load in response to sensing the one or more indications;

wherein sensing the one or more indications of changes in packaging material characteristics is performed during a first wrap operation, and changing the one or more wrap parameters used to wrap the load in response to sensing the one or more indications is performed during a second wrap operation.

2. The method of claim 1, wherein changing the one or more wrap parameters optimizes load wrapping apparatus performance and/or packaging material cost.

3. The method of claim 1, wherein changing the one or more wrap parameters reduces an incidence of film breaks.

4. The method of claim 1, wherein the one or more indications includes a packaging material gel, a packaging material hole, a force to pre-stretch at a given payout percentage, a tension at a payout percentage, an unwind force on a packaging material supply roll, and/or a visible packaging material roll surface.

5. The method of claim 4, wherein the visible packaging material roll surface includes one or more of a wrinkle, air entrapment, edge feather, edge flaw, torn edge, nicked edge, die line, and/or gauge band.

6. The method of claim 1, wherein the one or more wrap parameters includes a payout percentage, a tension, a pre-stretch percentage, and/or a packaging material feed control.

7. The method of claim 1, wherein the one or more wrap parameters includes a roping mechanism parameter that controls roping or rolling of an edge of the packaging material.

8. The method of claim 1, further comprising generating an alert to indicate to an operator an impact of any changes made.

9. The method of claim 1, wherein sensing the one or more indications is performed by a sensor array in a pre-stretch zone of the packaging material dispenser.

10. The method of claim 1, wherein sensing the one or more indications includes sensing a gel on the packaging material with an image sensor directed at a web of the packaging material.

11. The method of claim 1, wherein sensing the one or more indications includes sensing a hole in the packaging material with an ultrasonic sensor directed at a web of the packaging material.

12. The method of claim 1, wherein sensing the one or more indications includes sensing a force to pre-stretch at a given payout percentage with a force sensor coupled to an idle roller disposed between upstream and downstream dispensing rollers of a pre-stretch assembly.

13. The method of claim 1, wherein sensing the one or more indications includes sensing a tension at a given payout percentage with a force sensor coupled to an idle roller disposed downstream of a pre-stretch assembly.

14. The method of claim 1, wherein sensing the one or more indications includes sensing an unwind force on a packaging material supply roll with a force sensor coupled upstream of a pre-stretch assembly.

15. The method of claim 1, wherein sensing the one or more indications includes sensing a visible packaging material roll surface with an image sensor.

16. The method of claim 1, further comprising:

sensing a cessation of the one or more indications of changes in packaging material characteristics; and changing the one or more wrap parameters in response to sensing the cessation.

17. The method of claim 16, wherein changing the one or more wrap parameters in response to sensing the cessation includes restoring the one or more wrap parameters to original values.

18. A method of controlling a load wrapping apparatus of the type configured to wrap a load with packaging material dispensed from a packaging material dispenser through relative rotation between the packaging material dispenser and the load, the method comprising:

sensing one or more indications of changes in packaging material characteristics during one or more wrap operations; and changing one or more wrap parameters used to wrap the load in response to sensing the one or more indications;

wherein the one or more wrap parameters includes a roping mechanism parameter that controls roping or rolling of an edge of the packaging material.

19. The method of claim 18, wherein the one or more wrap parameters includes a payout percentage, a tension, a pre-stretch percentage, and/or a packaging material feed control.

20. The method of claim 18, wherein sensing the one or more indications is performed by a sensor array in a pre-stretch zone of the packaging material dispenser.

21. The method of claim 18, wherein sensing the one or more indications includes sensing a gel on the packaging material with an image sensor directed at a web of the packaging material.

22. The method of claim 18, wherein sensing the one or more indications includes sensing a hole in the packaging material with an ultrasonic sensor directed at a web of the packaging material.

23. The method of claim 18, wherein sensing the one or more indications includes sensing a force to pre-stretch at a given payout percentage with a force sensor coupled to an idle roller disposed between upstream and downstream dispensing rollers of a pre-stretch assembly.

24. The method of claim 18, wherein sensing the one or more indications includes sensing a tension at a given payout percentage with a force sensor coupled to an idle roller disposed downstream of a pre-stretch assembly.

25. The method of claim 18, wherein sensing the one or more indications includes sensing an unwind force on a packaging material supply roll with a force sensor coupled upstream of a pre-stretch assembly.

26. The method of claim 18, wherein sensing the one or more indications includes sensing a visible packaging material roll surface with an image sensor.

27. A method of controlling a load wrapping apparatus of the type configured to wrap a load with packaging material dispensed from a packaging material dispenser through relative rotation between the packaging material dispenser and the load, the method comprising:

sensing one or more indications of changes in packaging material characteristics during one or more wrap operations; and changing one or more wrap parameters used to wrap the load in response to sensing the one or more indications;

wherein sensing the one or more indications includes sensing a gel on the packaging material with an image sensor directed at a web of the packaging material.

28. The method of claim 27, wherein the one or more wrap parameters includes a payout percentage, a tension, a pre-stretch percentage, and/or a packaging material feed control.

29. The method of claim 27, further comprising:

sensing a cessation of the one or more indications of changes in packaging material characteristics; and changing the one or more wrap parameters in response to sensing the cessation, wherein changing the one or more wrap parameters in response to sensing the cessation includes restoring the one or more wrap parameters to original values.

30. The method of claim 27, wherein sensing the one or more indications of changes in packaging material characteristics is performed during a first wrap operation, and changing the one or more wrap parameters used to wrap the load in response to sensing the one or more indications is performed during a second wrap operation.

31. The method of claim 27, wherein sensing the one or more indications of changes in packaging material characteristics and changing the one or more wrap parameters used to wrap the load in response to sensing the one or more indications are performed during the same wrap operation.

32. A method of controlling a load wrapping apparatus of the type configured to wrap a load with packaging material dispensed from a packaging material dispenser through relative rotation between the packaging material dispenser and the load, the method comprising:

sensing one or more indications of changes in packaging material characteristics during one or more wrap operations; and changing one or more wrap parameters used to wrap the load in response to sensing the one or more indications;

wherein sensing the one or more indications includes sensing a hole in the packaging material with an ultrasonic sensor directed at a web of the packaging material.

33. The method of claim 32, wherein the one or more wrap parameters includes a payout percentage, a tension, a pre-stretch percentage, and/or a packaging material feed control.

34. The method of claim 32, wherein sensing the one or more indications is performed by a sensor array in a pre-stretch zone of the packaging material dispenser.

35. The method of claim 32, further comprising:

sensing a cessation of the one or more indications of changes in packaging material characteristics; and changing the one or more wrap parameters in response to sensing the cessation, wherein changing the one or more wrap parameters in response to sensing the cessation includes restoring the one or more wrap parameters to original values.

36. The method of claim 32, wherein sensing the one or more indications of changes in packaging material characteristics is performed during a first wrap operation, and changing the one or more wrap parameters used to wrap the load in response to sensing the one or more indications is performed during a second wrap operation.

37. The method of claim 32, wherein sensing the one or more indications of changes in packaging material characteristics and changing the one or more wrap parameters used to wrap the load in response to sensing the one or more indications are performed during the same wrap operation.

38. A method of controlling a load wrapping apparatus of the type configured to wrap a load with packaging material dispensed from a packaging material dispenser through relative rotation between the packaging material dispenser and the load, the method comprising:

sensing one or more indications of changes in packaging material characteristics during one or more wrap operations; and changing one or more wrap parameters used to wrap the load in response to sensing the one or more indications;

wherein sensing the one or more indications includes sensing a visible packaging material roll surface with an image sensor.

39. A method of controlling a load wrapping apparatus of the type configured to wrap a load with packaging material dispensed from a packaging material dispenser through relative rotation between the packaging material dispenser and the load, the method comprising:

sensing one or more indications of changes in packaging material characteristics during one or more wrap operations;

changing one or more wrap parameters used to wrap the load in response to sensing the one or more indications;

sensing a cessation of the one or more indications of changes in packaging material characteristics; and changing the one or more wrap parameters in response to sensing the cessation.

40. The method of claim 39, wherein the one or more indications includes a packaging material gel, a packaging material hole, a force to pre-stretch at a given payout percentage, a tension at a payout percentage, an unwind force on a packaging material supply roll, and/or a visible packaging material roll surface.

41. The method of claim 40, wherein the visible packaging material roll surface includes one or more of a wrinkle, air entrapment, edge feather, edge flaw, torn edge, nicked edge, die line, and/or gauge band.

42. The method of claim 39, wherein the one or more wrap parameters includes a payout percentage, a tension, a pre-stretch percentage, and/or a packaging material feed control.

43. The method of claim 39, wherein the one or more wrap parameters includes a roping mechanism parameter that controls roping or rolling of an edge of the packaging material.

44. The method of claim 39, further comprising generating an alert to indicate to an operator an impact of any changes made.

45. The method of claim 39, wherein sensing the one or more indications is performed by a sensor array in a pre-stretch zone of the packaging material dispenser.

46. The method of claim 39, wherein sensing the one or more indications includes sensing a gel on the packaging material with an image sensor directed at a web of the packaging material.

47. The method of claim 39, wherein sensing the one or more indications includes sensing a hole in the packaging material with an ultrasonic sensor directed at a web of the packaging material.

48. The method of claim 39, wherein sensing the one or more indications includes sensing a force to pre-stretch at a given payout percentage with a force sensor coupled to an idle roller disposed between upstream and downstream dispensing rollers of a pre-stretch assembly.

49. The method of claim 39, wherein sensing the one or more indications includes sensing a tension at a given payout percentage with a force sensor coupled to an idle roller disposed downstream of a pre-stretch assembly.

50. The method of claim 39, wherein sensing the one or more indications includes sensing an unwind force on a packaging material supply roll with a force sensor coupled upstream of a pre-stretch assembly.

51. The method of claim 39, wherein sensing the one or more indications includes sensing a visible packaging material roll surface with an image sensor.

52. The method of claim 39, wherein changing the one or more wrap parameters in response to sensing the cessation includes restoring the one or more wrap parameters to original values.

53. The method of claim 39, wherein sensing the one or more indications of changes in packaging material characteristics is performed during a first wrap operation, and changing the one or more wrap parameters used to wrap the load in response to sensing the one or more indications is performed during a second wrap operation.

54. The method of claim 39, wherein sensing the one or more indications of changes in packaging material characteristics and changing the one or more wrap parameters used to wrap the load in response to sensing the one or more indications are performed during the same wrap operation.

* * * * *